US005678495A

United States Patent [19]

Johansson et al.

[11] Patent Number: 5,678,495

[45] Date of Patent: Oct. 21, 1997

[54] DEVICE FOR COMBUSTION OF SOLID FUELS

[75] Inventors: Ulf Johansson, Borås; Sten Engwall, Märsta, both of Sweden

[73] Assignee: System Teeg AB, Marsta, Sweden

[21] Appl. No.: 586,718

[22] PCT Filed: Jul. 29, 1994

[86] PCT No.: PCT/SE94/00717

§ 371 Date: Apr. 29, 1996

§ 102(e) Date: Apr. 29, 1996

[87] PCT Pub. No.: WO95/04242

PCT Pub. Date: Feb. 9, 1995

[30] Foreign Application Priority Data

Jul. 30, 1993 [SE] Sweden ..... 9302534

[51] Int. Cl.[6] ..... F23G 5/12

[52] U.S. Cl. ..... 110/229; 110/224; 110/263

[58] Field of Search ..... 110/235, 243, 110/244, 250, 251; 431/5, 7, 170

[56] References Cited

U.S. PATENT DOCUMENTS 4,213,947 7/1980 Fremont et al. ..... 423/245

4,676,175 6/1987 Ledebrink et al. ..... 110/235

5,460,511 10/1995 Grahn ..... 431/5

OTHER PUBLICATIONS

WO 87/00909 to John E.M.B. Millns et al. entitled "Method and Apparatus for Buring Solid Fuel, " published 12 Feb. 1987.

Patent Abstracts of Japan, vol. 13, No. 206, M-826 of JP-A-1-28409, dated Jan. 31, 1989 to Fujioka et al.

*Primary Examiner*—Henry A. Bennett
*Assistant Examiner*—Pamela A. O'Connor
*Attorney, Agent, or Firm*—Watson Cole Stevens Davis, P.L.L.C.

[57] ABSTRACT

A device for the combustion of solid fuels so as to provide complete combustion from the start and thereby reduce environmental influence and the generation of carcinogens, includes two chambers interconnected by a ceramic filter, which chambers have one or more heat sources, one chamber being adapted for drying and degasification of the fuel and the other chamber being adapted for combustion of the gas generated on degasification. The heat sources are mainly connected with the solid-fuel device to act at an initial stage until combustion takes place in a normal way so that complete combustion may be achieved from the start.

3 Claims, 1 Drawing Sheet

DEVICE FOR COMBUSTION OF SOLID FUELS

DESCRIPTION

1. Technical Field

The present invention relates to a device for the combustion of solid fuels, a so called solid-fuel stove, which is usable for the heating of, for instance, water for heat exchangers/radiators located in houses and flats and/or for a water work system with tapping points for hot water. A solid-fuel stove of the above-mentioned type may be provided as an insert for a fireplace or the like or may be provided as a free-standing and separate unit.

2. Prior Art

On burning/combustion of solid fuels containing moisture, combustion must be preceded by drying/evaporation of the moisture content of the fuel at a temperature of around 100° C. and thereafter degasification of the fuel within a temperature range of 300°–500° C. Combustion should then take place at an ideal temperature of 1100° C. In modern boilers, stoves or the like, which often have, for instance, ceramic inserts in their combustion chambers so as for these in the heated condition to reflect and maintain combustion, a visible and imperfect combustion during the temperature raising period may go on for an hour or longer depending on the amount of ceramics and other material in the combustion chamber.

DESCRIPTION OF THE INVENTION

In order to quickly achieve complete combustion of solid fuels after ignition in a solid-fuel stove, meaning that complete combustion is achieved already on ignition/start, thereby to reduce environmental influence and generation of carcinogens, there has been developed a device for the combustion of solid fuels, a so called solid-fuel stove, comprising two chambers interconnected by a ceramic filter or the like. One chamber is adapted for drying and degasification of the fuel. The other chamber, which may be located under the first chamber, is adapted for combustion of the gas generated on degasification. One or more heat sources are connected with the solid-fuel stove to act at an initial stage for drying and degasification of the fuel and for giving the ceramic filter an operating temperature of 1100° C. until combustion can take place in a normal way unsupported by the heat sources and provide an effective bed of embers, part of the heat generated being used for continued drying and degasification of fresh fuel.

BRIEF DESCRIPTION OF THE FIGURE

The FIGURE shows a schematic cross section of a preferred embodiment of a solid-fuel stove according to the invention.

DETAILED DESCRIPTION OF THE PREFERRED EMBODIMENT

Figure 1:
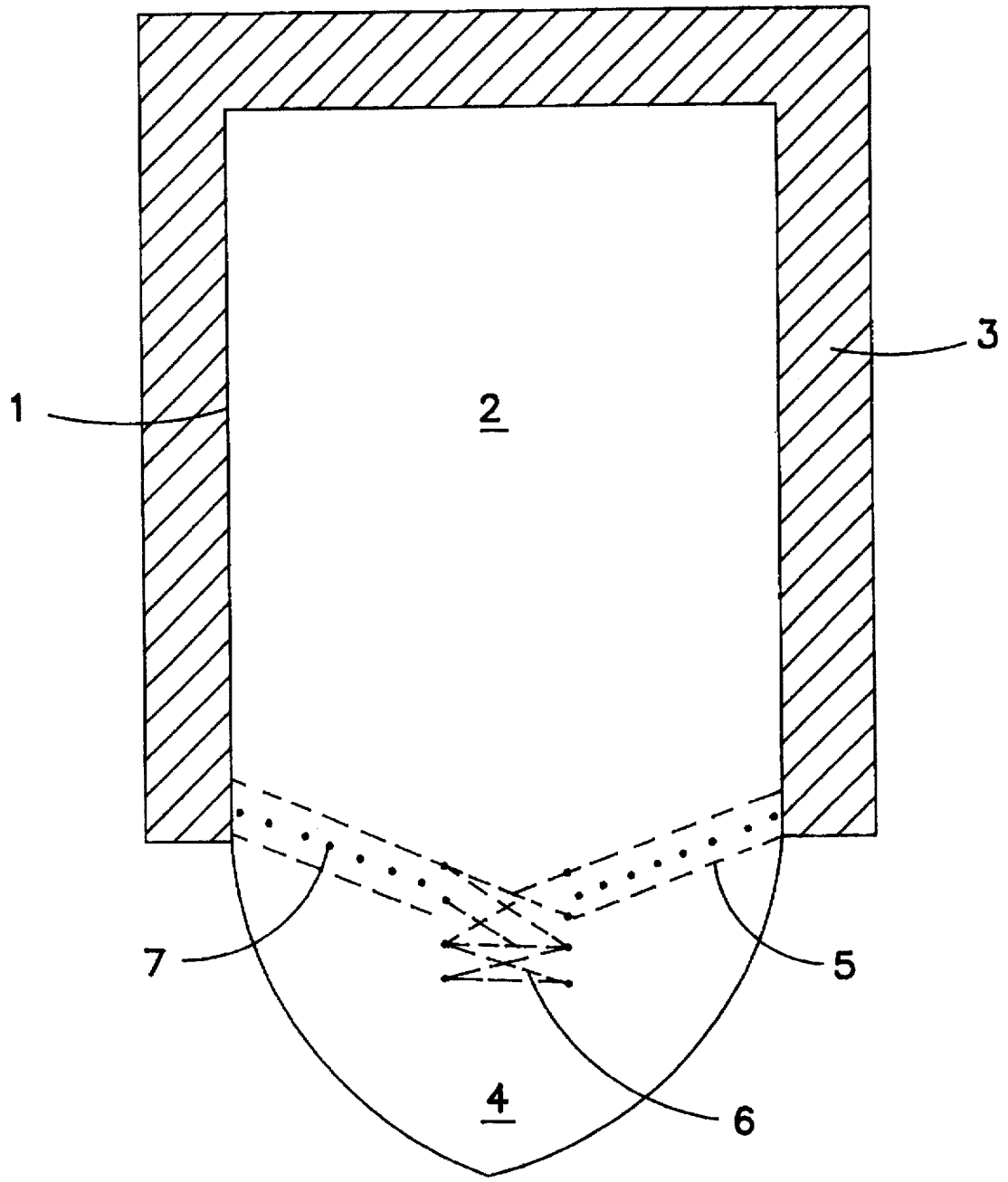

As indicated in the FIGURE, an upper chamber 2 in a solid-fuel stove 1 is provided for drying and degasification of the fuel at 100° C. and 300°–500° C., respectively. The upper chamber 2 may essentially be surrounded by a reflective material 3 such as ceramics. Between the upper chamber 2 and a lower chamber 4 for combustion of the gas generated on degasification there is provided a partition 5 having a ceramic filter 6 or the like with an operating temperature of 1100° C. In the partition 5, there may be disposed one or more heating sources 7 to provide a temperature of, for example, not more than 500° C. for drying and degasification. In the filter 6 there may be disposed one or more heat sources to give the filter an operating temperature of around 1100° C. Drying and degasification of the fuel and combustion of the gas generated on degasification are initiated by external energy supplied. The heat sources are thus provided to work at an initial stage but also thereafter to promptly secure complete combustion, such as on starting and on, for instance, a possible decrease in temperature in the stove depending on fuel being supplied or ashes being discharged. By means of the heat sources, such as electric current, gas or other kind of energy, the fuel is thus first dried and immediately thereafter energy supplied is recovered by permitting condensation of the gas generated, whereby it is possible to utilize the heat by, among others, returning it to the combustion air. After evaporation of the moisture at 100° C., the degasification phase then starts, whereupon the gas generated is forced to pass through the ceramic filter having an operating temperature of around 1100° C., the gas temperature immediately rising to a combustion temperature of around 1100° C. and a final combustion being achieved. In order to provide an improved behaviour, a frequency modulated fan may be arranged to start working at a predetermined temperature and to supply the amount of oxygen required to initiate a heating cycle and secure a flame temperature within an interval of 850°–1100° C. during the entire heating cycle, for instance on the insertion of wood when there will be a decrease in temperature.

With this kind of solid-fuel stove it is possible to utilize the energy-consuming but necessary drying of the fuel, since energy supplied may immediately be recovered and used further in the process. Also, there is achieved a complete combustion from the start, and carcinogens generated which have an influence on the environment and are harmful to the individual will therefore be eliminated, which would provide potentialities of continued small-scale solid-fuel heating also within densely built-up areas. When combustion takes place in a normal way and there is a bed of embers, the supply of external energy may be interrupted and drying, degasification and complete combustion are achieved at a high generation of heat. Should the combustion temperature deviate from the ideal combustion temperature, required energy other than the one from the solid fuel will be supplied.

We claim:

1. A device for combustion of solid fuels comprising means forming first and second chambers (2,4) interconnected by a partition (5) having a ceramic filter (6), said first chamber (2) functioning to dry and degasify fuel and said second chamber (4) functioning to combust gas generated from degasification, wherein a first heating means (7) is disposed in the partition (5) to provide an operating temperature in said first chamber (2) for drying and degasification of fuel therein and a second heating means is disposed in the filter (6) to provide an operating temperature for combustion, said first and second heating means functioning mainly at an initial stage of combustion but also thereafter to secure complete combustion.

2. A device according to claim 1, wherein said first and second chambers are located vertically relative to each other.

3. A device according to claim 1, wherein said first chamber is partly surrounded by reflective material for retaining heat therein.

* * * * *

UNITED STATES PATENT AND TRADEMARK OFFICE

CERTIFICATE OF CORRECTION

PATENT NO. : 5,678,495
DATED : October 21, 1997
INVENTOR(S) : Ulf Johansson et al.

It is certified that error appears in the above-indentified patent and that said Letters Patent is hereby corrected as shown below:

On the title page, item [73], should read

Assignee (Part Interest): System Teeg, AB,
Marsta, Sweden

Signed and Sealed this

Sixth Day of January, 1998

*Attest:*

*Attesting Officer*

BRUCE LEHMAN

*Commissioner of Patents and Trademarks*